US006503012B2

(12) United States Patent
Allen et al.

(10) Patent No.: US 6,503,012 B2
(45) Date of Patent: Jan. 7, 2003

(54) DISPLAY FOR REMOVABLE CARTRIDGE HAVING MEASURABLE PARAMETER

(75) Inventors: Loretta E. Allen, Hilton, NY (US); David M. Johnson, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 148 days.

(21) Appl. No.: 09/773,291

(22) Filed: Jan. 31, 2001

(65) Prior Publication Data

US 2002/0136585 A1 Sep. 26, 2002

(51) Int. Cl.[7] ..... B41J 29/62
(52) U.S. Cl. ..... 400/703; 400/708
(58) Field of Search ..... 400/70, 61, 76, 400/703, 74, 708; 355/72, 308

(56) References Cited

U.S. PATENT DOCUMENTS 4,748,479 A * 5/1988 Ohira et al. ..... 355/72
4,860,055 A * 8/1989 Ohira et al. ..... 355/72
4,954,910 A * 9/1990 Ueno ..... 346/136
5,021,826 A * 6/1991 Maruta ..... 399/23
5,036,361 A * 7/1991 Filion et al. ..... 345/690
5,237,522 A * 8/1993 Iwai ..... 377/8
5,469,364 A 11/1995 Hughey et al.
5,692,231 A * 11/1997 O et al. ..... 399/23
5,695,682 A 12/1997 Doane et al.
5,748,277 A 5/1998 Huang et al.

OTHER PUBLICATIONS

"Transient Dielectric Study of Bistable Reflective Cholesteric Displays and Design of Rapid Drive Scheme" by Xiao–Yang et al., Appl. Phys Letter 67 (9), Aug. 28, 1995, pp. 1211–1213.

* cited by examiner

*Primary Examiner*—Daniel J. Colilla
*Assistant Examiner*—Charles H. Nolan, Jr.
(74) *Attorney, Agent, or Firm*—Raymond L. Owens

(57) ABSTRACT

A removable cartridge with sheets that are to be removed from the cartridge and used by an apparatus comprising a housing for containing the sheets which are to be sequentially used by the apparatus when the cartridge is inserted into the apparatus, means provided in the housing for permitting sheets to be fed by the apparatus from the cartridge, a display provided on the housing which is viewable by a user when the cartridge is removed from the apparatus to indicate the number of sheets remaining in the cartridge. The display comprises a plurality of selectable digit elements each of which corresponds to a particular number, each selectable digit element containing cholesteric liquid crystals when selectively activated indicate a number that corresponds to the number of sheets remaining in the cartridge, and provide a measurable parameter.

8 Claims, 7 Drawing Sheets

DISPLAY FOR REMOVABLE CARTRIDGE HAVING MEASURABLE PARAMETER

CROSS REFERENCE TO RELATED APPLICATION

Reference is made to commonly-assigned U.S. patent application Ser. No. 09/045,016 filed Mar. 20, 1998, entitled "Display Having Viewable and Conductive Images" by Stanley W. Stephenson; U.S. patent application Ser. No. 09/597,134 filed Jun. 20, 2000, entitled "Driving a Memory Display in an Image Memory Card" by John R. Fredlund et al.; and U.S. patent application Ser. No. 09/669,178 entitled "Camera Having a Removable Display Provided on an Image Bearing Medium" by John R. Fredlund et al., the disclosures of which are incorporated herein by reference.

FIELD OF THE INVENTION

The present invention relates to a cartridge having sheets and provided with a visually readable, electrically updateable display having a measurable parameter.

BACKGROUND OF THE INVENTION

Current home printers consume blank sheets either by being hand fed one sheet at a time, from a cartridge, or from media tray. In each scenario, the user can determine the number of sheets remaining by visual inspection. Since these sheets are not light sensitive, the media is often visible from outside the printer housing. Typically, printers will also have a "load media" indicator that informs the user that the cartridge or media tray is empty. The user will then add fresh blank sheets to the existing cartridge or media tray. The media is often purchased in bulk, and only a portion of the bulk media is loaded into the cartridge or media tray at one time. The unused sheets are usually left in the cartridge or media tray for future use.

Today's home printers have become more sophisticated, even to the extent of using photosensitive and/or environmentally sensitive sheets for printing high quality images and photographs. By nature, these photosensitive sheets must be kept in the dark prior to use, meaning printer cartridges containing photosensitive sheets are light tight. Photosensitive sheets usually have special storage requirements as well, meaning that when not in use it should be kept in a special container and not subjected to extremes in temperature and/or humidity. The result is that a cartridge containing photosensitive sheets can be partially used in a printer, then removed and stored for later use. The cartridge typically comes with a designated number of sheets, and once fully consumed, the cartridge is discarded. If the sheets in the cartridge are not fully consumed, the user is left with a partially consumed cartridge. Unless the user makes a manual notation regarding the number of sheets previously consumed, the user has no way of determining the number of sheets remaining in the cartridge, or if there isn't any sheet at all.

SUMMARY OF THE INVENTION

Accordingly, it is an object of the present invention to provide an electrically actuated display on a cartridge for indicating the number of sheets in the cartridge.

It is another object of the present invention to provide a display on a cartridge that presents an image to a viewer even when the voltage to the display is removed.

It is another object of the present invention to provide a display on a cartridge that presents an image to a viewer even when the voltage to the display is removed, and is electrically readable by an apparatus.

It is yet another object of the present invention to provide a display on a cartridge that presents an image to a viewer even when the voltage to the display is removed, is electrically readable by an apparatus, and can be updated by the apparatus.

It is still yet another object of the present invention to provide an apparatus that can electrically read and write to a display on a cartridge that presents an image to a viewer.

These objects are achieved in a removable cartridge with sheets that are to be removed from the cartridge and used by an apparatus comprising:

a) a housing for containing the sheets which are to be sequentially used by the apparatus when the cartridge is inserted into the apparatus;

b) means provided in the housing for permitting sheets to be fed by the apparatus from the cartridge; and c) a display provided on the housing which is viewable by a user when the cartridge is removed from the apparatus to indicate the number of sheets remaining in the cartridge, including:

i) the display having a plurality of selectable digit elements each of which corresponds to a particular number, each selectable digit element containing cholesteric liquid crystals when selectively activated indicate a number that corresponds to the number of sheets remaining in the cartridge, and provide a measurable parameter;

ii) the apparatus including circuitry being responsive to the measurable parameter to determine the number provided on the display and to change the selectable digit elements to indicate a new number in response electrical signals provided by the apparatus indicating that a sheet has been removed from the cartridge and inserted into the apparatus and which continues to indicate the present number of sheets remaining in the cartridge after such cartridge has been removed from the apparatus.

It is a feature of the present invention that the display on the cartridge presents an image when high voltage to the display is turned off.

It is a further feature of the present invention to provide a display on a cartridge that has a measurable parameter.

It is a further feature of the present invention to provide an apparatus having means to measure said measurable parameter on a cartridge.

It is a further feature of the present invention to provide an indication on the cartridge of the number of sheets remaining in the cartridge.

DETAILED DESCRIPTION OF THE INVENTION

Figure 1:
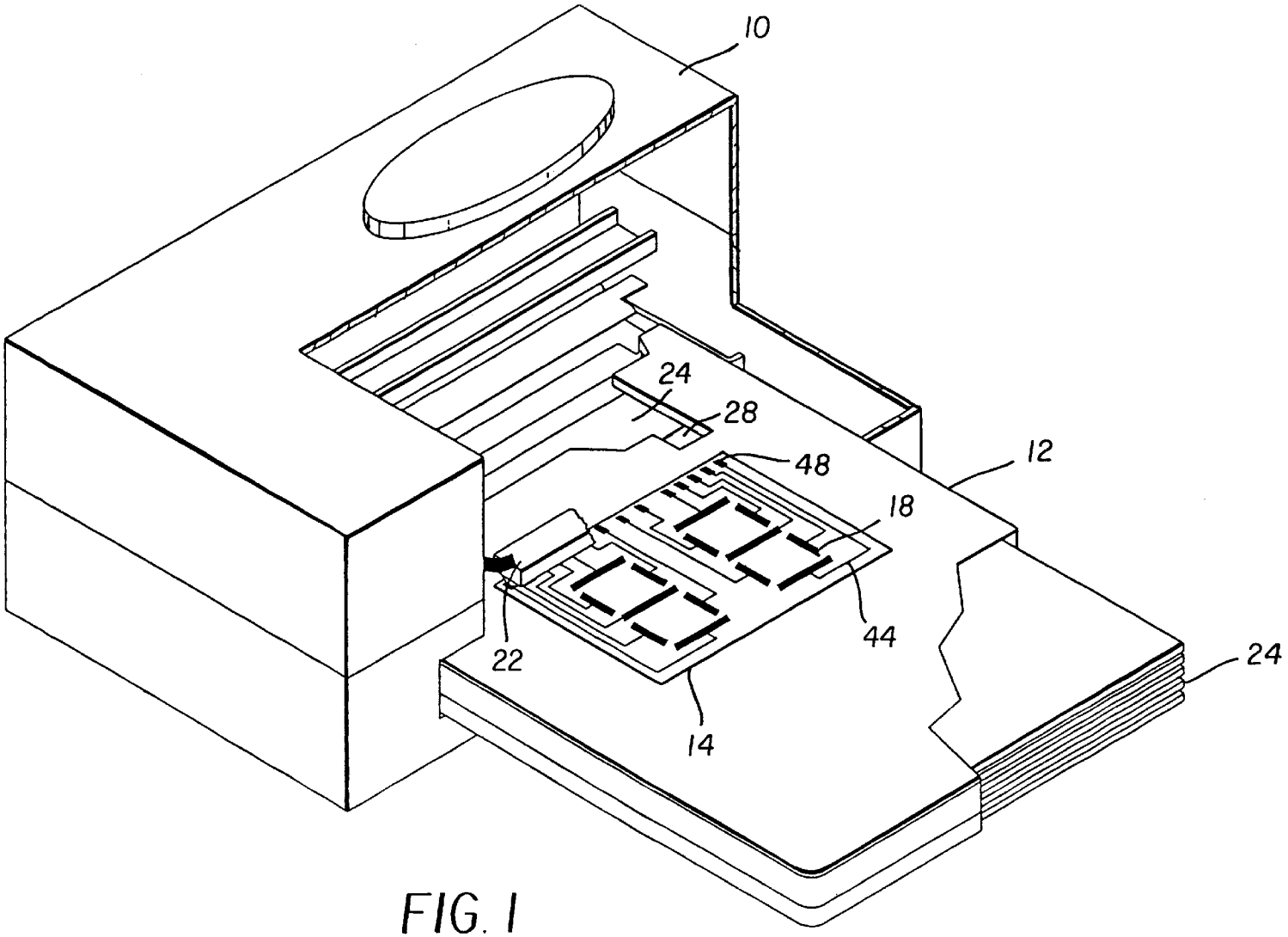
FIG. 1 is a pictorial of a printer and a partially broken away cartridge being inserted into the printer in accordance with the present invention.

FIG. 1 is a pictorial of a printer 10 with a partially broken away removable cartridge 12. The cartridge 12 comprises sheets 24 and a display 14. The display 14 is a bistable reflective cholesteric display. The sheets 24 are sensitive to light and the cartridge is light tight. A light lock door 28 on cartridge 12 is pushed opened as the cartridge is inserted into the printer 10 allowing the top sheet to come in contact with a pick roller (not shown). The pick roller uses friction to remove one sheet at a time from the cartridge 12 and feed it forward through the printer.

Figure 2:
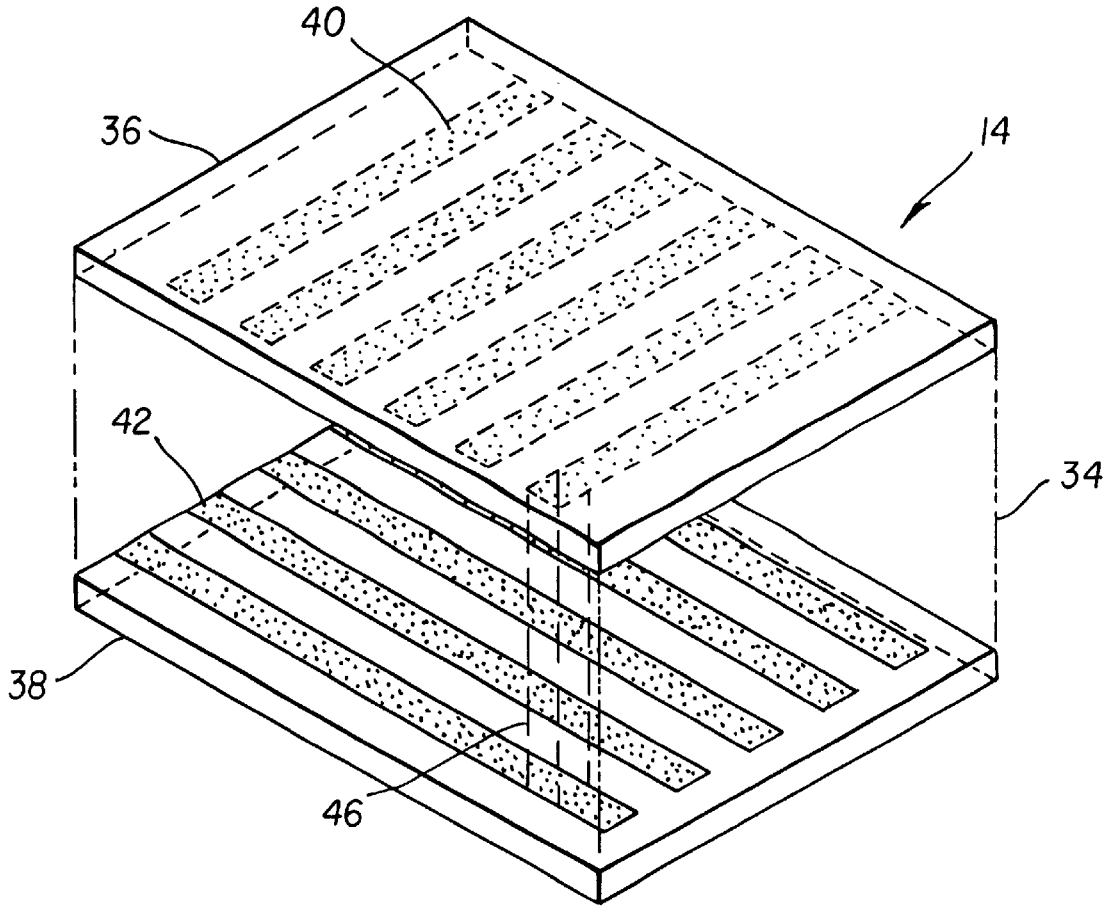
FIG. 2 shows an exploded view of a display that can be mounted on the cartridge of FIG. 1.

FIG. 2 is an exploded view of display 14 in accordance with the present invention. Cholesteric liquid crystals 34 are disposed between a top support 36 comprising transparent top conductors 40, and a bottom support 38 comprising bottom conductors 42. Bottom conductor 42 can be a transparent electrical conductor such as indium-tin-oxide or a light absorbing conductor formed by an oxide of a metal such as platinum or nickel. Cholesteric liquid crystals 34 can be a chiral doped nematic liquid crystals such as those disclosed in U.S. Pat. No. 5,695,682. Applied electrical fields of various intensity and duration change the condition of chiral doped nematic materials from a reflective to a transmissive mode. These materials have the advantage of maintaining a given condition indefinitely after the field is removed. Ambient light striking the display when it is in the reflective mode can be reflected light providing a "light" image, or when the display is in the transmissive mode can become absorbed light providing a "dark" image. The light modulation is effective in two conditions, which will be described in more detail below. Cholesteric liquid crystals materials can be Merck BL112, BL118 or BL126 which are available from EM Industries of Hawthorne, N.Y. In one experiment, two glass plates were coated with transparent Indium-Tin-Oxide (ITO) to form transparent top conductor 40 and bottom conductor 42. A laser beam was used to pattern the ITO coatings, and 4-micron spacer beads were applied to one of the plates. The two plates were bonded together, with the spacer beads providing a 4-micron gap between the two plates. Black paint was applied to the back of the bottom support 38 to absorb light passing through the cholesteric liquid crystals 34. The gap between the plates was filled with E. M. Industries (Hawthorne, N.Y.) chiral nematic fluid BL126 to act as cholesteric liquid crystals 34. Printer 10 comprises a circuit 22 that controls whether or not selectable digit elements 18 of display 14 are in the reflective or transmissive mode. Transparent top conductors 40 and bottom conductors 42 on display 14 both have exposed electrodes 48 mounted on the ends of electrical leads 44. When cartridge 12 is inserted in printer 10, electrodes 48 on display 14 make electrical contact with the control circuit 22 located in printer 10. A 3-millisecond pulse at 100 volts across common areas 46 on transparent top conductor 40 and bottom conductor 42 converts the BL126 cholesteric liquid crystals 34 in the corresponding selectable digit element 18 to the reflective mode. A 3-millisecond pulse at 40 volts converts the cholesteric liquid crystals 34 in the corresponding selectable digit element 18 to the transmissive mode. Each selectable digit element 18 of display 14 is electrically addressed by a drive circuit well known in the art. An example of one such drive circuit is described in detail in U.S. Pat. No. 5,748,277 "Dynamic Drive Method and Apparatus for a Bistable Liquid Crystal Display" assigned to Kent State University. One skilled in the art will recognize that this is a typical driving scheme using row and column drivers. Briefly, selective control of the voltage applied to the electrodes determines the electric potential applied across the liquid crystals material defining the selectable digit element beneath the electrodes. By control of the voltage, this potential can be adjusted and, more specifically, can be controlled in accordance with a method for choosing between a selectable digit element in the reflective mode and a selectable digit element in the transmissive mode.

Figure 3:
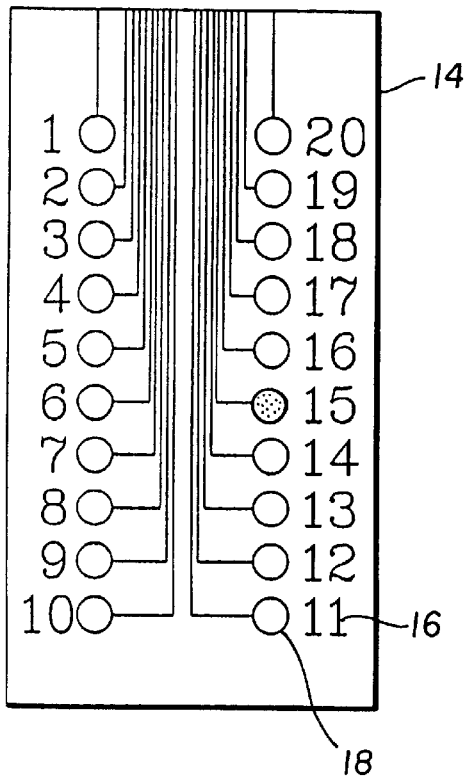
FIG. 3 shows a display comprising a series of selectable digit elements having cholesteric liquid crystals wherein only one of such elements is selected at any one given time to indicate the number of sheets remaining in the cartridge.
Figure 4:
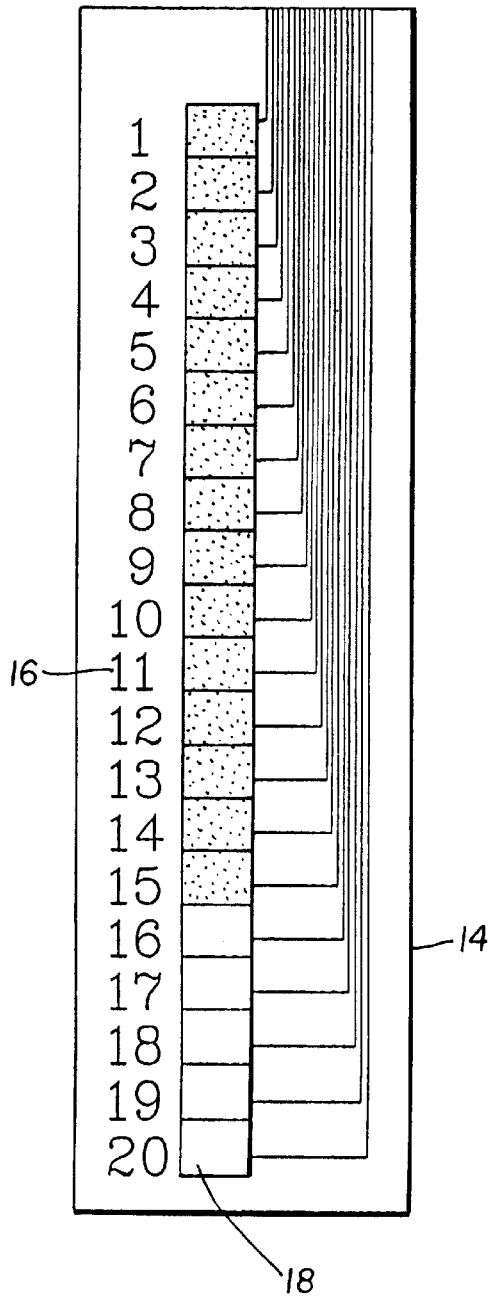
FIG. 4 shows a display similar to FIG. 3. but where one or more selectable elements can be selected at any one given time to provide a "gas gauge" style display.
Figure 5:
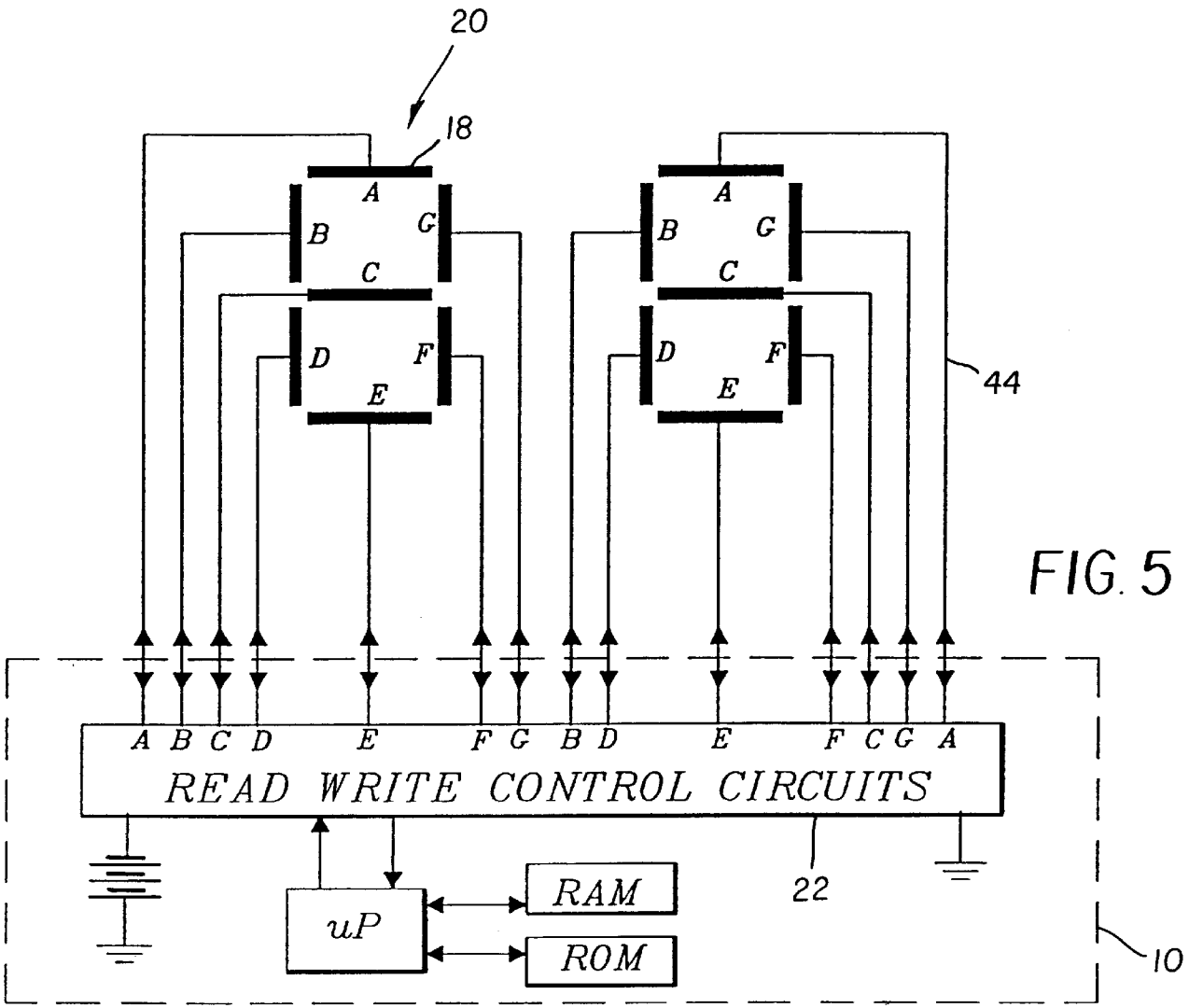
FIG. 5 shows a display having two digits and including a plurality of selectable digit elements each of which contains cholesteric liquid crystals and control circuitry for operating these segments.

FIGS. 3, 4, and 5 are different embodiments of the displays that can be used in accordance with the present invention. Whenever it is indicated that a display is mounted on a cartridge, it is understood that the display can be mounted, for example, in a recess in the cartridge and, most importantly, that the display be visible by the user. For example in FIG. 3, indicia 16 are printed next to selectable digit elements 18 of display 14. Selectable digit elements 18 corresponding to indicia "1–14" and "16–20" are in the transmissive mode, and the selectable digit element next to indicia 15 is in the reflective mode. This would indicate to the user that there are 15 sheets of media remaining in the cartridge 12. Alternately, the selectable digit elements themselves could be masked with the shapes of the desired indicia.

Referring now to FIG. 4, indicia 16 are printed next to selectable digit elements 18 of display 14. Again, each selectable digit element of display 14 is electrically addressed by control means well known in the art. As shown in this figure, selectable digit elements 18 corresponding to indicia "1–15" are in the reflective mode, and the selectable digit elements 18 next to indicia "16–20" are in the transmissive mode. This is a "gas-gauge" type counter, and would indicate to the user that there are 15 sheets of media remaining in the cartridge 12. The main difference between FIGS. 3 and 4 is that in FIG. 3, only one selectable digit element 18 is activated to indicate the number of sheets in the cartridge, whereas in FIG. 4, one or more selectable digit elements 18 are activated. The operation of the displays of FIGS. 3 and 4 are very similar to that of FIG. 5, and will be quite clear after reviewing the description of FIG. 5.

FIG. 5 is a display where each digit 20 includes seven selectable digit elements 18 referenced respectively as A, B, C, D, E, F, and G. The mode of each selectable digit element 18 is controlled by the control circuit 22 comprising Read and Write controls. While FIG. 5 shows an example of a two-digit display, it will be understood that any number of digits may be used, and that many variations in character or image configurations may be controlled.

Figure 5A:
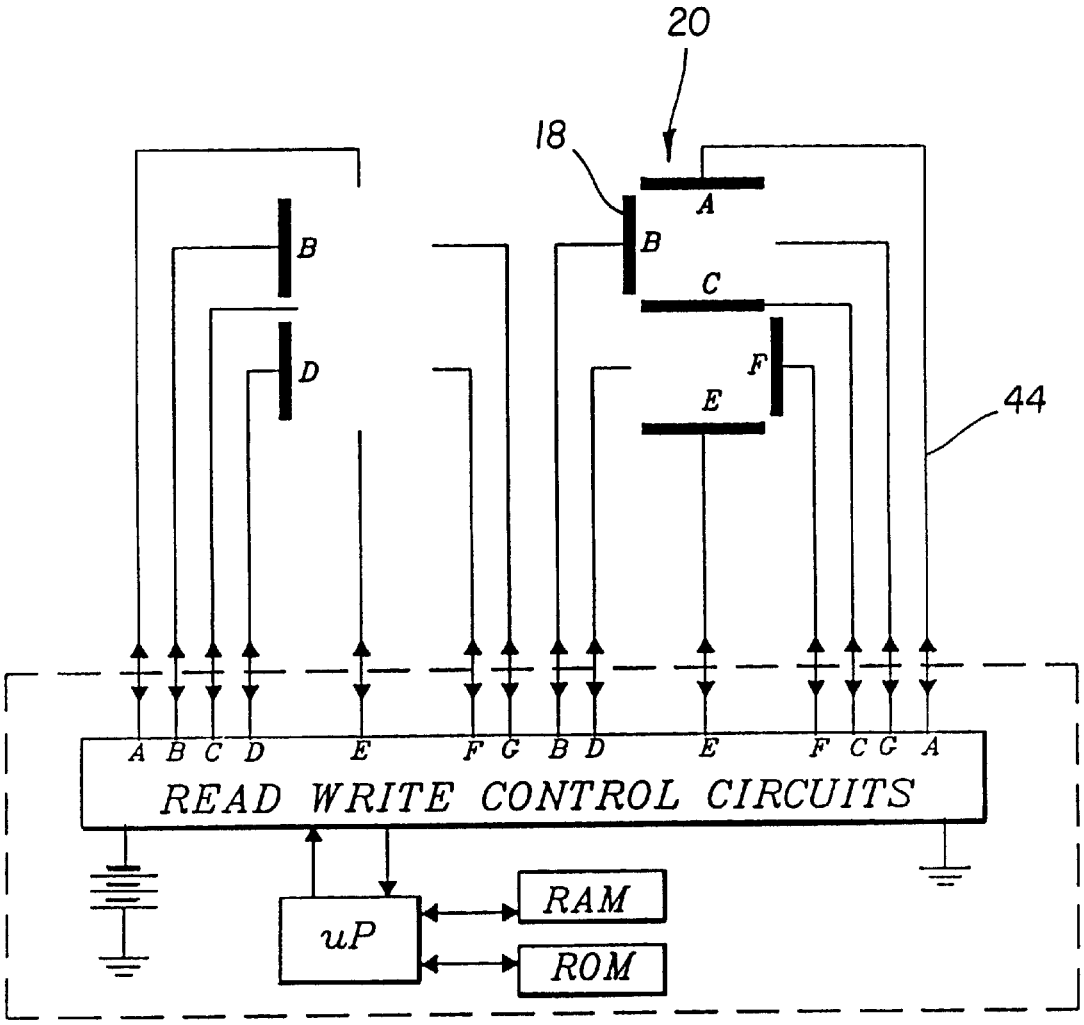
FIG. 5*a* shows the display of FIG. 5 indicating the number "15"

FIG. 5*a* shows the display of FIG. 5 indicating the number "15" for the purpose of clarity. In order for display 14 to reflect the number "15", selectable digit elements G and F of the first digit are in the reflective mode, and selectable digit elements A, B, C, D and E are in the transmissive mode. At the same time, selectable digit elements A, B, C, E and F of the second digit are in the reflective mode, and selectable digit elements D and G are in the transmissive mode.

Table 1 shown below shows the various permutations and combinations from "00" to "20" which can be used in activating the selectable digit elements 18 of each digit 20 to depict different numbers which correspond to the number of sheets remaining in the cartridge. This is possible because each selectable digit element 18 has a unique position, and is capable of being in the reflective mode having a low capacitance value, or the transmissive mode having a high capacitance value. For a two-digit display, numerals "00" through "99" are possible, each having a unique combination of selectable digit element positions vs. capacitance value (low or high). Therefore, for a two-digit display, each displayed numeral "00" through "99" has a corresponding unique measurable parameter.

TABLE 1

| | 1st Digit Selectable Digit Elements A–G | | | | | | | 2nd Digit Selectable Digit Elements A–G | | | | | | |
|---|---|---|---|---|---|---|---|---|---|---|---|---|---|---|
| Numerals | A | B | C | D | E | F | G | A | B | C | D | E | F | G |
| 00 | low | low | high | low | low | low | low | low | low | low | low | high | low | low |
| 01 | low | low | high | low | low | low | low | high | high | high | high | high | low | low |
| 02 | low | low | high | low | low | low | low | high | low | low | high | low | low | low |
| 03 | low | low | high | low | low | low | low | high | high | low | low | low | low | low |
| 04 | low | low | high | low | low | low | low | low | high | high | low | low | low | high |
| 05 | low | low | high | low | low | low | low | low | high | low | low | low | high | low |
| 06 | low | low | high | low | low | low | low | low | low | low | low | low | high | low |
| 07 | low | low | high | low | low | low | low | high | high | high | low | high | low | low |
| 08 | low | low | high | low | low | low | low | low | low | low | low | low | low | low |
| 09 | low | low | high | low | low | low | low | low | high | high | low | low | low | low |
| 10 | high | high | high | high | high | low | low | low | low | low | low | high | low | low |
| 11 | high | high | high | high | high | low | low | high | high | high | high | high | low | low |
| 12 | high | high | high | high | high | low | low | high | low | low | high | low | low | low |
| 13 | high | high | high | high | high | low | low | high | high | low | low | low | low | low |
| 14 | high | high | high | high | high | low | low | low | high | high | low | low | low | high |
| 15 | high | high | high | high | high | low | low | low | high | low | low | low | high | low |
| 16 | high | high | high | high | high | low | low | low | low | low | low | low | high | low |
| 17 | high | high | high | high | high | low | low | high | high | high | low | high | low | low |
| 18 | high | high | high | high | high | low | low | low | low | low | low | low | low | low |
| 19 | high | high | high | high | high | low | low | low | high | high | low | low | low | low |
| 20 | high | low | low | high | low | low | low | low | low | low | low | high | low | low |

Examples of such displays are described in journal article "Transient dielectric study of bistable reflective cholesteric displays and design of rapid drive scheme" by Xiao-Yang Hunang, et al., Applied Physics Letter 67 (9), 28 August 1995. This article also describes the change of selectable digit element capacitance during transition from the reflective mode to the transmissive mode.

Figure 6:
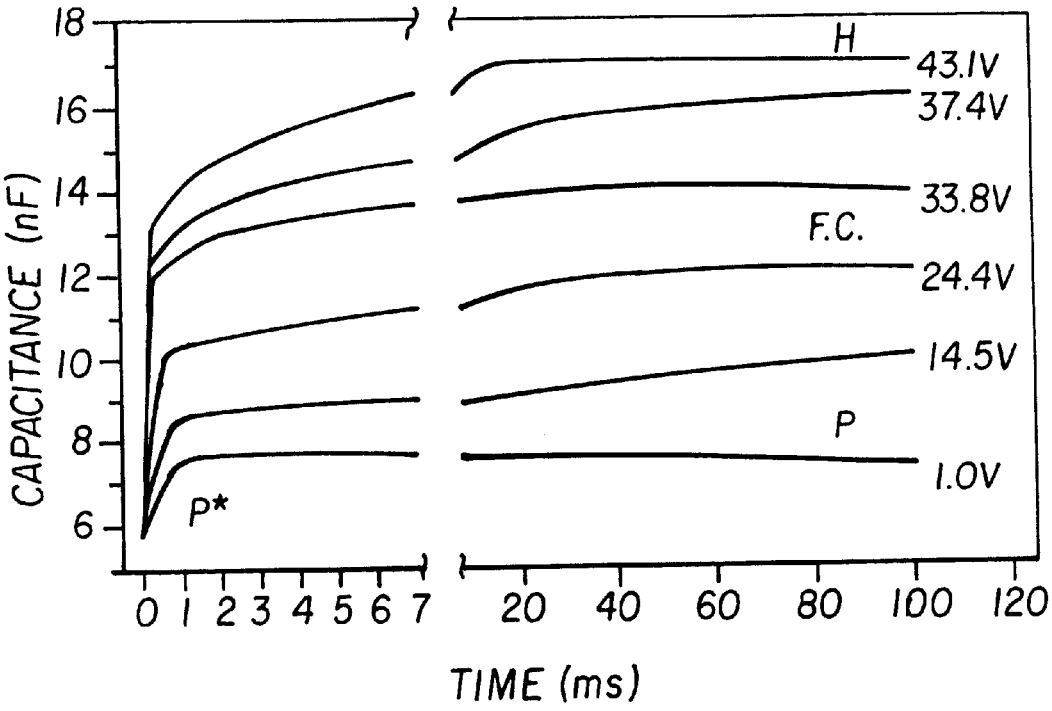
FIG. 6 is a graph showing capacitance vs. time for cholesteric liquid crystals which are used in displays in accordance with the present invention.

FIG. 6 is a graph showing "capacitance value" vs. "time" for cholesteric liquid crystals 34 which are used in displays in accordance with the present invention. The selectable digit element 18 is initially in the transient planar state (P*) and has a minimum capacitance. When a low bias voltage is applied, the liquid crystals evolve to a planar state (P) or the reflective mode as mentioned earlier. At a medium bias voltage, the liquid crystals evolve to a focal-conic state (F.C.) or the transmissive mode as mentioned earlier. At a high bias voltage, the liquid crystals evolve to a homeotropic state (H). This invention relies on the parameters of the planar and focal-conic states only. The planar (P) selectable digit element 18 is in the reflective mode that reflects light, providing a light image and has low capacitance value. The focal-conic (F.C.) selectable digit element 18 in the transmissive mode absorbs light, providing a dark image and has high capacitance. In an experiment, the capacitance on a single selectable digit element having the dimensions 0.1 cm×0.3 cm was measured while in the planar and focal conic states. The planar state resulted in a measurement of 39 pF, while the focal conic state resulted in a measurement of 47 pF.

Figure 7:
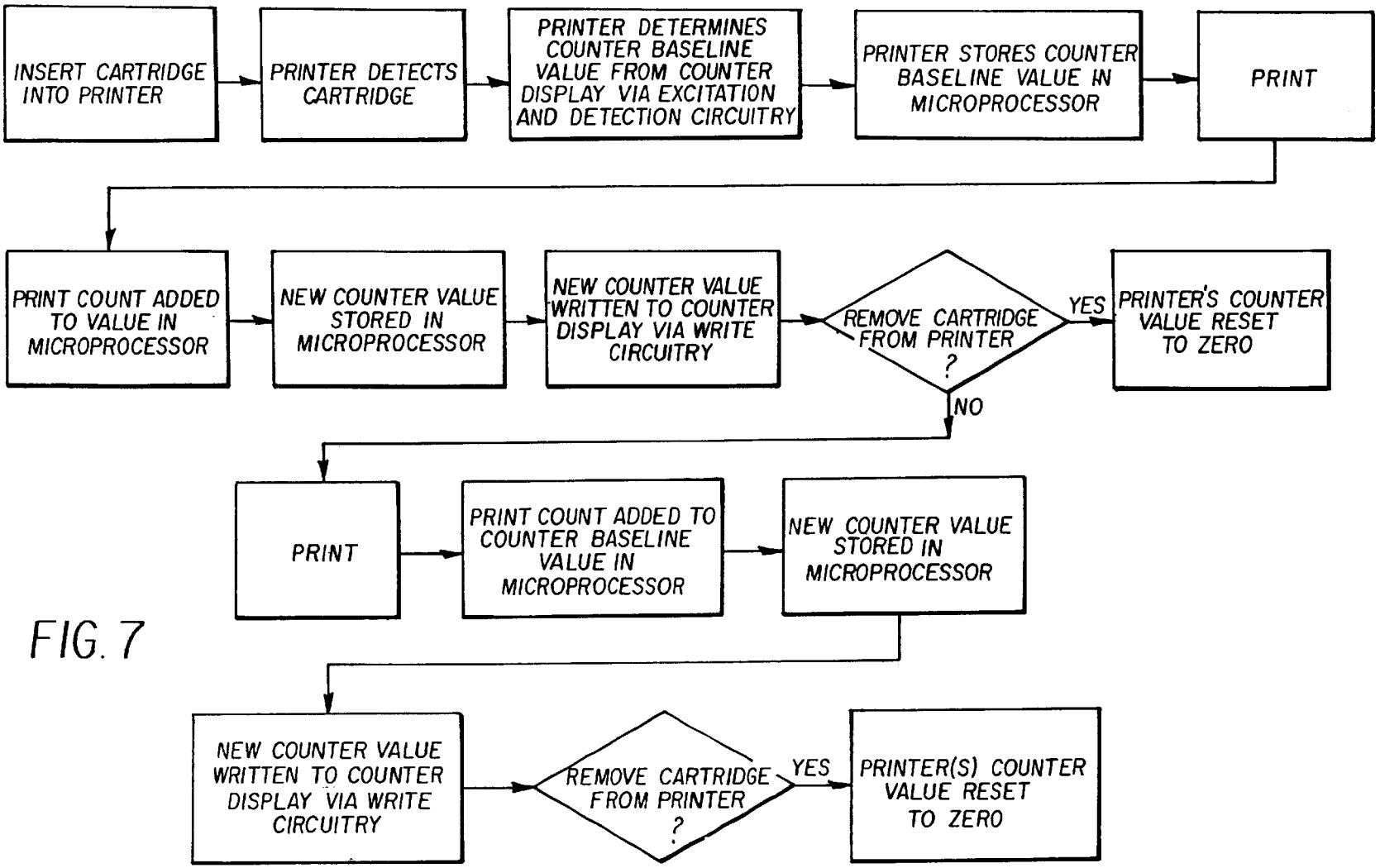
FIG. 7 is a block diagram showing varying stages for operating the display on the removable cartridge in accordance with the present invention.

FIG. 7 is a block diagram showing varying stages for operating the display 14 on the removable media cartridge 12 in accordance with the present invention. In a real life situation display 14 on cartridge 12 is electrically preset to display the correct number corresponding to the number of sheets inserted into the cartridge during assembly. For example, a display as shown in FIG. 3 is preset to display the number "20". Initially, selectable digit element 18 corresponding to "20" is in the reflective mode, and selectable digit elements 18 corresponding to "0–19" are in the transmissive mode. The current number that is visible on display 14 is also electrically readable by printer 10. Each selectable digit element 18 corresponding to numbers "0–20" comprises electrodes 48. The control circuit 22 located in printer 10 comprises Read and Write circuitry, and is electrically coupled to electrodes 48 on display 14 when cartridge 12 is inserted into printer 10. A sensor (not shown) senses the presence of cartridge 12 and sets the READ/WRITE signal to READ which activates a detection and excitation circuit within the Read circuitry. By setting the READ circuitry, a low voltage signal is sent to each of the selectable digit elements 18 by the excitation circuit. This voltage is smaller than the voltage required to change the mode of the cholesteric liquid crystals 34. The detection circuit measures the voltage of each selectable digit element 18 through a sensing resistor and determines if the selectable digit element 18 is in the reflective or transmissive mode by comparing the measured voltage to a stored reference value in a look-up table. This method of measuring the electrical properties of a capacitor is a typical RC time constant method that is well known in the art. An example of one such method is disclosed in U.S. Pat. No. 5,469,364, "Apparatus and Methods For Measuring and Detecting Variations In The Value Of A Capacitor" by Hughey et al. If the measured voltage is below the reference voltage, the selectable digit element is in the reflective mode, and if the measured voltage is above the reference voltage, the selectable digit element is in the transmissive mode. The current number that is visible on display 14 is also the current selectable digit element that is in the reflective mode. By determining which selectable digit element is in the reflective mode, the printer can also determine the quantity of media in the cartridge by comparing the coordinates of said selectable digit element to a look up table. This number is stored in the printer's memory and becomes a reference number until a print is made. During a printing cycle, the READ/WRITE signal is set to WRITE. Initially, the WRITE signal sends a pulse of low voltage across all selectable digit elements to convert the cholesteric liquid crystals 34 to the transmissive mode. After the selectable digit elements have been converted, the reference quantity is retrieved from memory and incrementally updated by the number of prints made. This new reference number replaces the previous reference number in the printer's memory. At the same time, the display is updated with the new number corresponding to the current number of sheets remaining in the cartridge by selectively sending a pulse of high voltage across the selectable digit element 18 whose coordinates match that of the new reference number as described in the look up table. Once the cartridge is removed and the sensor no longer senses the presence of a cartridge in the printer, the number is cleared from the printer's memory.

The invention has been described in detail with particular reference to certain preferred embodiments thereof, but it will be understood that variations and modifications can be effected within the spirit and scope of the invention.

PARTS LIST

10 printer
12 removable cartridge
14 display
16 indicia
18 selectable digit elements
20 digit
22 control circuit
24 sheets
28 light lock door
34 cholesteric liquid crystals
36 top support
38 bottom support
40 transparent top conductor
42 bottom conductor
44 electrical leads
46 common areas
48 electrodes

What is claimed is:

1. A removable cartridge with sheets that are to be removed from the cartridge and used by an apparatus comprising:

a) a housing for containing the sheets which are to be sequentially used by the apparatus when the cartridge is inserted into the apparatus;

b) means provided in the housing for permitting sheets to be fed by the apparatus from the cartridge; and c) a display provided on the housing which is viewable by a user when the cartridge is removed from the apparatus to indicate the number of sheets remaining in the cartridge, including:

i) the display having a plurality of selectable digit elements each of which corresponds to a particular number, each selectable digit element containing cholesteric liquid crystals when selectively activated indicate a number that corresponds to the number of sheets remaining in the cartridge, and provide a measurable parameter;

ii) the apparatus including circuitry being responsive to the measurable parameter to determine the number provided on the display and to change the selectable digit elements to indicate a new number in response electrical signals provided by the apparatus indicating that a sheet has been removed from the cartridge and inserted into the apparatus and which continues to indicate the present number of sheets remaining in the cartridge after such cartridge has been removed from the apparatus.

2. The removable cartridge of claim 1 wherein a single selectable digit element is activated to indicate the number of sheets remaining in the cartridge.

3. The removable cartridge of claim 1 wherein two or more selectable digit elements are activated to indicate the number of sheets remaining in the cartridge.

4. A removable cartridge with sheets that are to be removed from the cartridge and used by an apparatus comprising:

a) a housing for containing the sheets which are to be sequentially used by the apparatus when the cartridge is inserted into the apparatus;

b) means provided in the housing for permitting sheets to be fed by the apparatus from the cartridge; and c) a display provided on the housing which is viewable by a user when the cartridge is removed from the apparatus to indicate the number of sheets remaining in the cartridge, including:

i) the display having at least one selectable digit element including a plurality of segments each of which contains cholesteric liquid crystals when selectively activated indicate a number that corresponds to the number of sheets remaining in the cartridge, and provide a measurable parameter;

ii) the apparatus including circuitry being responsive to the measurable parameter to determine the number provided on the display and to change the segments and indicate a new number in response electrical signals provided by the apparatus indicating that a sheet has been removed from the cartridge and inserted into the apparatus and which continues to indicate the present number of sheets remaining in the cartridge after such cartridge has been removed from the apparatus.

5. The removable cartridge of claim 4 wherein the apparatus determines the number of sheets in a cartridge by measuring the parameter in each segment, and the cholesteric liquid crystals of each segment are responsive to a field provided by the electrical signals to change from either a transparent to a reflective state or from a reflective to a transparent state.

6. The removable cartridge of claim 4 wherein the cholesteric liquid crystals of each segment are arranged so that when they are in a reflective state, they indicate a particular number.

7. The removable cartridge of claim 4 wherein each segment includes cholesteric liquid crystals that are effective in the transparent and reflected states.

8. The removable cartridge of claim 7 where there are at least two selectable digit elements.

* * * * *